US011148855B1

(12) United States Patent
Shannon

(10) Patent No.: US 11,148,855 B1
(45) Date of Patent: Oct. 19, 2021

(54) RECEPTACLES AND CASES FOR STORING BEAUTY PRODUCTS

(71) Applicant: Ainsley Shannon, Portland, ME (US)

(72) Inventor: Ainsley Shannon, Portland, ME (US)

( * ) Notice: Subject to any disclaimer, the term of this patent is extended or adjusted under 35 U.S.C. 154(b) by 0 days.

(21) Appl. No.: 16/290,288

(22) Filed: Mar. 1, 2019

Related U.S. Application Data

(60) Provisional application No. 62/637,087, filed on Mar. 1, 2018, provisional application No. 62/654,484, filed on Apr. 8, 2018, provisional application No. 62/692,919, filed on Jul. 2, 2018.

(51) Int. Cl.

| | |
|---|---|
| ***B65D 21/02*** | (2006.01) |
| ***B65D 25/20*** | (2006.01) |
| ***B65D 25/10*** | (2006.01) |
| *A46B 9/02* | (2006.01) |

(52) U.S. Cl.
CPC ..... *B65D 21/0228* (2013.01); *B65D 25/108* (2013.01); *B65D 25/20* (2013.01); *A46B 9/021* (2013.01)

(58) Field of Classification Search
CPC B65D 21/0228; B65D 21/02; B65D 21/0209; B65D 21/023; B65D 25/108; B65D 25/107; B65D 25/102; B65D 25/10; B65D 25/20; A46B 9/021; A46B 2200/1046; B44D 3/125; B44D 3/123; B44D 3/121
See application file for complete search history.

(56) References Cited

U.S. PATENT DOCUMENTS

| | | | | |
|---|---|---|---|---|
| 8,113,219 | B1 * | 2/2012 | Chang | A45D 33/36 132/299 |
| 9,848,723 | B1 * | 12/2017 | Huang | A46B 17/08 |
| 10,017,321 | B2 * | 7/2018 | Empey | B65B 7/28 |
| 2013/0270264 | A1 * | 10/2013 | Suljak | B65D 25/2811 220/4.03 |
| 2014/0091086 | A1 * | 4/2014 | Sorensen | A47G 19/2205 220/4.27 |
| 2014/0238949 | A1 * | 8/2014 | Patel | A47G 19/2272 215/6 |
| 2016/0318658 | A1 * | 11/2016 | Whitley | B65D 21/0209 |
| 2016/0368661 | A1 * | 12/2016 | Moore | B65D 47/286 |
| 2018/0141712 | A1 * | 5/2018 | Hendricks | B65D 43/0225 |

* cited by examiner

*Primary Examiner* — Don M Anderson

(57) ABSTRACT

A case for storing one or more cosmetic tools has a first portion, a second portion, and at least one further portion. The first portion has a bottom surface, a top opening, one or more side walls, and an internal cavity. The second portion has a top surface, a bottom opening, one or more side walls, and an internal cavity. Each further portion has one or more side walls and at least one end opening, and an internal cavity. Each of the first, second and further portions has a connector at least at each opening. The first and second portions have mating connectors such that they can be connected to form an enlarged combined internal cavity. The further portions can be connected between the first and second connectors to further enlarge the combined internal cavity, or to a bottom/top of the first/second portion to create a separate second internal cavity.

12 Claims, 13 Drawing Sheets

RECEPTACLES AND CASES FOR STORING BEAUTY PRODUCTS

This application claims the benefit of U.S. Provisional Application Nos. 62/637,087, filed Mar. 1, 2018; 62/654,484, filed Apr. 8, 2018; and 62/692,919, filed Jul. 2, 2018, each of which is hereby incorporated by reference in its entirety.

FIELD OF THE INVENTION

The application relates generally to cases for storing beauty products, and specifically for brushes and other tools commonly used to apply beauty products, including, but not limited to, makeup, cosmetics, and the like.

BACKGROUND

In the cosmetic and beauty industry, there are many conventional cases for holding and retaining beauty products, in particular tools to apply beauty products, such as brushes and other similar tools. Such cases range from hard-shell cases, which may be made of metalized structure, to soft-shell cases, which may be made of fabric, that possess zip closures.

Specifically, there are a few predominant types of cases for securing makeup brushes and other similar brushes for applying beauty products. One common type of case is cylindrical, or predominantly cylindrical, in shape, comprising multiple parts or modules that secure or couple together using a variety of types of closures, including, but not limited to, metal snap buttons, hook and loop fasteners (such as Velcro®), and quick-release buckle clips.

Another conventional type of case, commonly called a "Brush Roll," comprises one or more elasticized bands sewn into a large piece of fabric, into which makeup brushes and other brushes for applying beauty products may be inserted. The one or more elasticized bands secure the brushes in place. A user may then roll the fabric on to itself, from one end to the other, to create a generally spiral-shaped, compact case in which the brushes are secured inside the roll of fabric.

Yet another conventional type of case also has one or more elasticized bands that are sewn in place to the lid of an existing cosmetic case. In many instances, the one or more bands are sold or purchased separately as an optional, additional segment of the existing cosmetic case. The one or more bands are generally used in the same way as the "Brush Roll"-type case, i.e., with makeup brushes and other brushes for applying beauty products secured by way of the one or more bands.

All of the aforementioned conventional cases, however, suffer from several problems. Such cases offer only a "one size fits all" solution that does not take into account varying heights, widths, and physical dimensions of makeup brushes or other similar tools. For example, certain cases may not be able to accommodate overly tall brushes, while short brushes must often be kept in cases that accommodate the tallest brush an individual owns, leading to excess space and disorganization within the interior of the case.

Additional problems are specific to both hard-shell, cylindrical cases and soft, fabric cases, such as the "Brush Roll"-type cases. Hard-shell, cylindrical cases often fail to secure brushes or other similar tools, and are simply generalized holding receptacles. Lack of securing brushes in this fashion may result in damage, especially when carrying such cases from one place to another, in luggage while traveling, and other similar situations. Further, the bristles of brushes are often damaged when attempting to cover such cases with the provided lid. Bristles may be crushed, snagged, or splayed by lids, especially if such lids are tight-fitting.

Soft, fabric cases, such as the "Brush Roll"-type cases, suffer from several problems as well. Since these cases are made of fabric, they are difficult to clean, especially when they come into physical contact with oil-base cosmetic products, such as foundations, creams, or powders.

Finally, conventional cases fail to adequately accommodate new beauty products, such as beauty sponges, resulting in the development of separate storage containers for new beauty products that arrive on the market. Having a multitude of separate cases for separate beauty products is inefficient and increases the amount of physical space an individual must have in order to store all of his or her beauty products.

As a result, there exists a need for improved cases for storing beauty products, including, but not limited to, brushes and other tools used to apply such beauty products.

SUMMARY

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description.

In general, the present invention is directed to a case for storing beauty products, and specifically for brushes and other tools commonly used to apply beauty products, including, but not limited to, makeup, cosmetics, and the like. In some embodiments of the invention, the case comprises a base having a plurality of surfaces, with one or more hooks or other attachment points disposed on at least one of the plurality of surfaces. The case may also comprise one or more rubberized or elasticized bands that are configured to be attached to the one or more hooks.

One of skill in the art will appreciate that the deployment of a plurality of rubberized or elasticized bands attached to a plurality of hooks can create a grid-like environment into which cosmetic tools, including, but not limited to, makeup brushes, may be inserted, secured, and held in place. It will be further appreciated that such grid-like environment will better secure cosmetic tools than conventional cases, especially in situations where a case embodying the invention is turned upside down or sideways. It should also be appreciated that such grid-like environment enables holding and securing of a wide variety of types of cosmetic tools of varying shapes, sizes, and volumes. Because the hooks are on a portion of the base which has no side walls around it (at least, before assembly of the case), the hooks can be easily accessed by a user and utilized to develop the custom grid or matrix by attachment of the bands to the hooks.

Certain embodiments of the invention comprise one or more hollow top portions that secure to the base. In some aspects of the above embodiments, two top portions are utilized, a first top portion and a second top portion. The first top portion is secured to the second top portion, and the second and/or first top portion is secured to the base. Usage of two top portions prevents damage to cosmetic tools when the case is assembled, including, but not limited to, splayed and split hairs on brushes. In additional aspects of the above embodiments, only one top portion is utilized, which secures to the base. In other aspects, the base and top portion are formed as a single piece. Cosmetic tools may then be stored by insertion through the top portion, thereby preventing such tools from being damaged or compromised.

A case embodying the present invention may also comprise a lid that may be attached at a top of the case, opposite the base. In embodiments where the base has a closed lower end, connection of the lid to the top of the top portion creates an enclosed hollow space where cosmetic tools may be held and secured. In embodiments where the base is open on its lower end, connection of the lid to the top of the top portion, combined with connection of a second lid or a compartment with a closed bottom to the bottom of the base creates the enclosed hollow space.

Additional embodiments of the invention comprise an add-on receptacle that is configured to secure to the base. By being secured to the bottom of the base, the add-on receptacle does not interfere with opening of the lid and accessing any objects inserted into the case via the top opening of the top portions/base. Such add-on receptacle is capable of holding and retaining additional cosmetic tools, including, but not limited to, one or more beauty sponges.

Cases embodying the invention may also comprise one or more means of fastening or securing the base and other portions of the case to each other. Such means are well-known to those of skill in the art and may include, for example, threads, hook and loop fasteners (including Velcro®), magnetic closures, snap-joints, buckle clips, and the like. An additional means of fastening or securing the base and other portions of the case to each other comprises a spine-like rigid material that is disposed on all portions of the case, thereby connecting each portion individually.

In some embodiments, the case is highly modular, allowing for significant modification by a user to adapt the case to use with various implements of various shapes and sizes. For example, the base may be open at the bottom and top so that it can be expanded in each direction by add-on compartments, which themselves may be open at the top and bottom for further expansion (or closure by lids) or closed at the top or bottom. There may be interchangeable top portions of various heights for accommodating variously sized items to be stored in the case, etc. Furthermore, there may be one or more base portions having hooks or other attachments points for elastic bands or similar, which may be directly adjacent and attached to one another, or separated by one or more expander portion, for greater security of stored items, particularly for tall cases. In some embodiments, the base may be tall and have two or more sets of hooks (or other attachment points), and each set of hooks (or other attachment points) may be substantially in its own plane. Or, a set of hooks may be on the interior of the top portions or another expansion portion, in addition to on the base, for example around the interior perimeter of the top portions or expander. In other embodiments, the case may be less modular or not modular. For example, the case may be a hollow cylinder with a top and a bottom that screw together, the bottom portion being the base and incorporating a plurality of hooks or other attachments points for elastic bands or other dividers for segmenting the case into a number of spaces for insertion of objects.

One of skill in the art will appreciate that cases embodying the present invention may be constructed of any suitable, solid material, particularly one that is easy to clean, especially with respect to makeup products, including, but not limited to, hard, durable plastics. Although the embodiments of the case shown are hollow cylinders in shape, one of skill in the art will appreciate that any variety of shapes may be used without substantially altering the functionality of the case—for example a hollow rectangular prism or various hollow extruded shapes such as an extruded oval, triangle, etc.

In some embodiments, a new case for storing one or more cosmetic tools includes a first portion that comprises one or more projections and one or more second portions, at least one of the one or more second portions being configured to attach to the first portion to form a case, the case having a shape including an internal cavity for storing one or more cosmetic tools, the projections being configured such that elastic bands may be attached between them to divide space in the internal cavity. In such embodiments, the projections may be placed in a first plane. The projections may extend outwards. The projections may be distributed around an outer perimeter of the first portion. The projections may be hooks. The outer perimeter of the first portion may be circular. The one or more second portions may form a side wall that surrounds the projections.

Such embodiments may further include one or more bands configured to attach to the one or more projections. The bands may be attached to the one or more projections and form a grid dividing the space in the internal cavity, into which items may be placed. The bands may be either elasticized or rubberized.

In such embodiments, at least one of the one or more second portions may have two separate halves. The first portion may include a cavity on an exterior surface of the first portion, the cavity defining an attachment space. At least one of the one or more second portions may have an attachment portion configured to attach to the base. The attachment portion may have a first half and a second half, the first half including a first protrusion and the second half including a second protrusion, the first protrusion and the second protrusion fitting into the attachment space defined by the cavity.

The one or more second portions may include a lid.

An add-on component may be configured to attach to the first portion, extending vertically below the first portion.

In some embodiments, a new case for storing one or more cosmetic tools includes a base that has one or more hooks, one or more bands configured to attach to the one or more hooks, thereby forming a plurality of spaces for securably storing one or more cosmetic tools, and a top that has two halves, each of the two halves being configured to attach to the base, thereby forming an internal cavity vertically above and/or encircling the plurality of spaces for securably storing one or more cosmetic tools.

The top may include a hollow interior defined by the two halves when attached to the base. The top may be cylindrical in shape when attached to the base. A lid may be configured to attach to the two halves opposite the base. An add-on component may be configured to attach to a side of the base opposite the top. Each of the one or more bands may be elasticized or rubberized. A plurality of connection mechanisms selected from the group consisting of threads, hook and loop fasteners, buckle closures, magnetic closures, and snap joints, may be configured to connect to the base or the top.

In some embodiments, a new method for securing one or more cosmetic tools involves attaching a plurality of bands to a plurality of hooks, each of the plurality of bands physically contacting two or more of the plurality of hooks, thereby creating a plurality of tensed bands, and inserting a cosmetic tool into the plurality of tensed bands, thereby securing the cosmetic tool between two or more portions of the plurality of tensed bands. The two or more portions of the plurality of tensed bands touch the cosmetics tool and press the cosmetics tool between them, thereby exerting a securing frictional force on the cosmetics tool. The one or more cosmetic tools may include one or more makeup brushes. Such embodiments may also involve arranging the plurality of tensed bands such that each of the plurality of tensed bands crisscrosses at least one other of the plurality of tensed bands, thereby creating a grid of tensed bands. Each of the plurality of bands may be either elasticized or rubberized.

In some embodiments, a new case for storing one or more cosmetic tools includes a first portion having a bottom surface, a top opening, and one or more first side walls extending upwards from a perimeter of the bottom surface and forming, together with the bottom surface, a first internal cavity for storing one or more cosmetics tools therein, a second portion comprising a top surface, a bottom opening, and one or more second side walls extending downwards from a perimeter of the top surface and forming, together with the top surface, a second internal cavity, and one or more further portions each having one or more further side walls and at least one further opening at an end of the further side walls, the further side walls encircling a further internal cavity. The first sidewalls have a first connector at the top opening, the second sidewalls have a second connector at the bottom opening, and the further sidewalls have a further connector at each of the at least one further openings. The first connector is configured to mate and connect with the second connector. Each further connector is configured to mate and connect with the first connector or the second connector. The first portion, the second portion, and/or one or more of the further portions further has a supplemental connector on an end of the first sidewall, second sidewall or further sidewall opposite to the first connector, second connector or further connector, the supplemental connector configured to mate with and connect to at least one of the first connector and the second connector. The first portion and the second portion, when the first and second connectors are mated and connected, merge the first internal cavity and the second internal cavity to form a combined internal cavity for receiving one or more cosmetics tools therein. Each further portion is configured, when connected by the further connector to the first portion or the second portion, to merge the further internal cavity with the first internal cavity or the second internal cavity to form a different combined internal cavity, to expand the combined internal cavity, or to create a further closed internal cavity for receiving one or more items separated from the one or more cosmetics tools by a barrier.

The one or more further portions may include one or more double-open portions each having two openings, one at each end of the side walls of each double-open portion, each double-open portion having one of the further connectors on the double-open portion side walls at each of the two openings, where each of the double-open portions is configured, when connected by the further connector to the first portion or the second portion, to expand the combined internal cavity.

The one or more further portions may include one or more single-open portions each having a single opening and a further top surface or a further bottom surface but not both, the further side walls of each single-open portion extending upwards from a perimeter of the further bottom surface or downwards from a perimeter of the further top surface and forming, together with the further bottom surface or the further top surface, a further internal cavity, wherein each of the single-open portions is configured, when connected by the further connector to the supplemental connector of the first portion or the second portion, to create a further closed internal cavity including the further internal cavity, for receiving one or more items separated from the one or more cosmetics tools by a barrier, and when connected by the further connector to the top opening or the bottom opening, to merge the further internal cavity with the first internal cavity or the second internal cavity to form a different combined internal cavity.

At least one of the first and second portions may have a plurality of projections configured such that elastic bands may be attached between them to divide space in the first or second internal cavity. The case may also include one or more bands configured to attach to the one or more projections. The bands may be attached to the one or more projections and form a grid dividing the space in the first internal cavity or the second internal cavity, into which items may be placed.

The case may also include a base portion that has one or more projections and one or more upper portions, at least one of the one or more upper portions being configured to attach to the base portion to form a base internal cavity for storing one or more cosmetic tools, the projections being configured such that elastic bands may be attached between them to divide space in the base internal cavity, the base portion including a bottom surface having a base connector configured to connect to and mate with the first connector or the second connector. The projections may be placed in a first plane. The projections may extend outwards. The projections may be distributed around an outer perimeter of the first portion. The projections may be hooks. The outer perimeter of the base portion may be circular. The one or more upper portions may form a side wall that surrounds the projections. The case may also include one or more bands configured to attach to the one or more projections. The bands may be attached to the one or more projections and form a grid dividing the space in the base internal cavity, into which items may be placed.

At least one of the one or more upper portions may have two separate halves. The base portion may include a cavity on an exterior surface of the base portion, the cavity defining an attachment space. At least one of the one or more upper portions may also include an attachment portion configured to attach to the base. The attachment portion may have a first half and a second half, where the first half includes a first protrusion and the second half includes a second protrusion, and where the first protrusion and the second protrusion fit into the attachment space defined by the cavity.

An advantage of some embodiments of the present invention is the ability to insert makeup brushes/tools into the case from above—for example by removing a lid and dropping the brush or other item into the cavity the lid was covering—making insertion easier and less likely to damage brushes. Another advantage of some embodiments is the presence of an add-on compartment for beauty sponges (or other items) that a user would want to be able to readily access without having to dig through other items in the main cavity and/or would not want to have to remove to get to other items in the main cavity. Another advantage of some embodiments is the removability and interchangeability of various portions of the case for ready customization, depending on the items the user wishes to carry in the case at any given time, for example depending on the particular job or application. Being able to mix and match pieces such as attaching a lid to the add on compartment or to the main portion of the case, being able to add or remove add-on compartments, expand the size of internal cavities, etc., makes the case extremely flexible and allows the user to consolidate other cases into this single case. Such advantages are hitherto completely unknown on the market.

These and further and other objects and features of the invention are apparent in the disclosure, which includes the above and ongoing written specification, as well as the drawings.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art.

DETAILED DESCRIPTION

Figure 1:
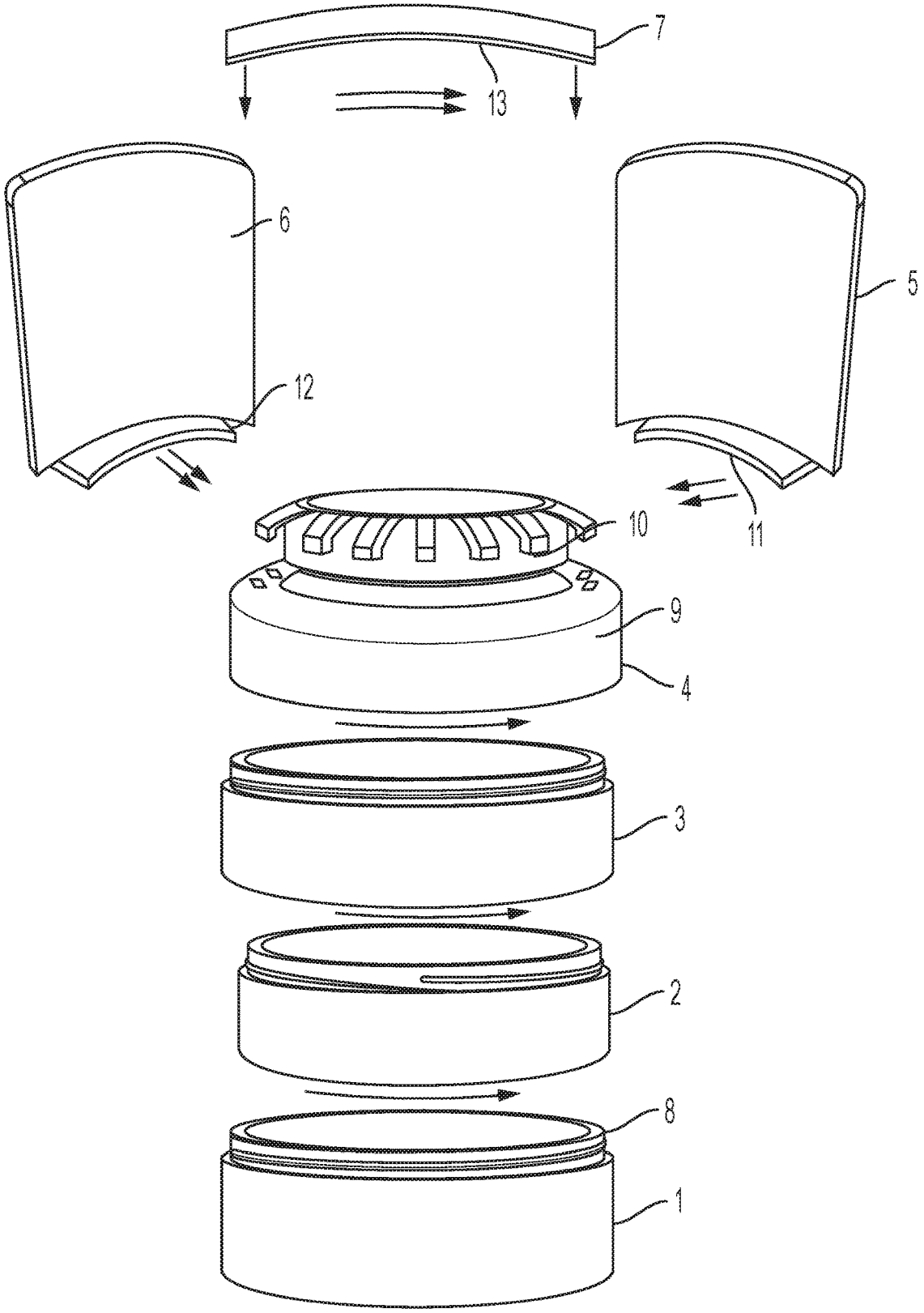
FIG. 1 is a diagram that presents an exploded side view of a case that embodies the present invention.

The present invention is more fully described below with reference to the accompanying figures. The following description is exemplary in that several embodiments are described (e.g., by use of the terms "preferably," "for example," or "in one embodiment"); however, such should not be viewed as limiting or as setting forth the only embodiments of the present invention, as the invention encompasses other embodiments not specifically recited in this description, including alternatives, modifications, and equivalents within the spirit and scope of the invention. Further, the use of the terms "invention," "present invention," "embodiment," and similar terms throughout the description are used broadly and not intended to mean that the invention requires, or is limited to, any particular aspect being described or that such description is the only manner in which the invention may be made or used. Additionally, the invention may be described in the context of specific applications; however, the invention may be used in a variety of applications not specifically described.

In the several figures, like reference numerals may be used for like elements having like functions even in different drawings. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail. Any signal arrows in the drawings/figures should be considered only as exemplary, and not limiting, unless otherwise specifically noted. Further, the description is not to be taken in a limiting sense, but is made merely for the purpose of illustrating the general principles of the invention, since the scope of the invention is best defined by the appended claims.

It will be understood that, although the terms first, second, etc. may be used herein to describe various elements, these elements should not be limited by these terms. These terms are only used to distinguish one element from another. Purely as a non-limiting example, a first element could be termed a second element, and, similarly, a second element could be termed a first element, without departing from the scope of example embodiments. As used herein, the term "and/or" includes any and all combinations of one or more of the associated listed items. As used herein, the singular forms "a", "an," and "the" are intended to include the plural forms as well, unless the context clearly indicates otherwise. It should also be noted that, in some alternative implementations, the functions and/or acts noted may occur out of the order as represented in at least one of the several figures. Purely as a non-limiting example, two figures shown in succession may in fact be executed substantially concurrently or may sometimes be executed in the reverse order, depending upon the functionality and/or acts described or depicted.

Generally, the present invention relates to a case for storing beauty products, and specifically for brushes and other tools commonly used to apply beauty products, including, but not limited to, makeup, cosmetics, and the like. In some embodiments, the case may be comprised of a plurality of individual components, including, but not limited to, a base, one or more hollow top portions, a lid, and an add-on component. Each of the plurality of individual components is configured to secure to at least one other of the plurality of individual components, thereby enabling assembly of a case with a hollow interior, in which cosmetic tools are held and secured. In some embodiments of the present invention, cosmetic tools may be held and secured in the case through one or more rubberized or elasticized bands that are configured to be attached to a plurality of hooks disposed on a surface of the base.

FIG. 1 illustrates a side view of an exemplary case, according to one embodiment of the invention. A solid, non-hollow base 4 has a series of hooks 10 disposed on a surface of the base. The series of hooks provide a means of attachment for one or more rubberized or elasticized bands (not pictured), enabling holding and securing of cosmetic tools.

Two halves of a cylinder 5 and 6 form a top portion of the case and both of the two halves attach to the base through protrusions 11 and 12, which are configured to attach to a cavity 9 disposed on the base. Such protrusion/attachment mechanisms are well known. Attachment of the two halves 5 and 6 to the base thereby creates a hollow interior defined by the two halves 5 and 6, and the base 4. Such attachment may be made by any means known to one of skill in the art. Purely as a non-limiting example, one or more portions of the two halves 5 and 6, as well as the base 4, may be threaded in such a way that threaded portion(s) of the two halves 5 and 6 complement the threaded portion(s) of the base 4. Additionally, the two halves 5 and 6 are preferably of sufficient vertical height such that any cosmetic tools disposed in the case do not protrude above the top of the two halves 5 and 6. In such embodiments, the two halves 5 and 6 help secure cosmetic tools, especially if such tools are of varying physical heights and dimensions, against inadvertent content from outside the case.

The case further comprises a lid 7, which is configured to attach to both of the two halves 5 and 6 once the two halves are secured to the base by way of attachment of the protrusions 11 and 12 to cavity 9. It will be appreciated that the lid 7 may be screwed or otherwise attached in any suitable manner to the two halves 5 and 6. The lid 7 may also be threaded. It will further be appreciated that attachment of the lid to the two halves creates a hollow, enclosed interior defined by the lid 7, the two halves 5 and 6, and the base 4.

An optional add-on component 1 may be attached to the base 4 through hollow bottom 2 and hollow extender 3. As depicted in FIG. 1, the base 4 is configured to attach to extender 3, which in turn is configured to attach to bottom 2, which in turn is configured to attach to add-on component 1. The add-on component 1, in conjunction with either bottom 2 and/or extender 3 provides an additional, hollow, enclosed interior for storage of additional cosmetic tools, including, but not limited to, beauty sponges.

Various portions of the case possess threads 8 that enable each portion to easily attach to other components. Specifically, add-on component 1, bottom 2, extender 3, base 4, two halves 5 and 6, and lid 7 all comprise threads that enable attachment in the manner described above. It should be appreciated that different or additional means of attachment may be used other than threads. It should further be appreciated that the case depicted in FIG. 1 is modular in nature, such that certain portions of the case need not be utilized, according to a user's preference. Purely as a non-limiting example, a user could elect not to use add-on component 1, bottom 2, and/or extender 3, depending on that user's needs.

One of skill in the art will appreciate that various portions of the case, including, but not limited to, add-on component 1, bottom 2, extender 3, base 4, two halves 5 and 6, and/or lid 7, may be attached together using one or more commonly known means, such as, for example, threads, hook and loop fasteners (including Velcro®), buckle closures, magnets and magnetic closures, and snap joints. Additional attachment means, including, for example, a spine-like rigid material that is disposed on all portions of the case, thereby connecting each portion individually. Further illustration and description of the attachment means referenced herein will be provided in the descriptions associated with FIGS. 4-8.

Figure 2B:
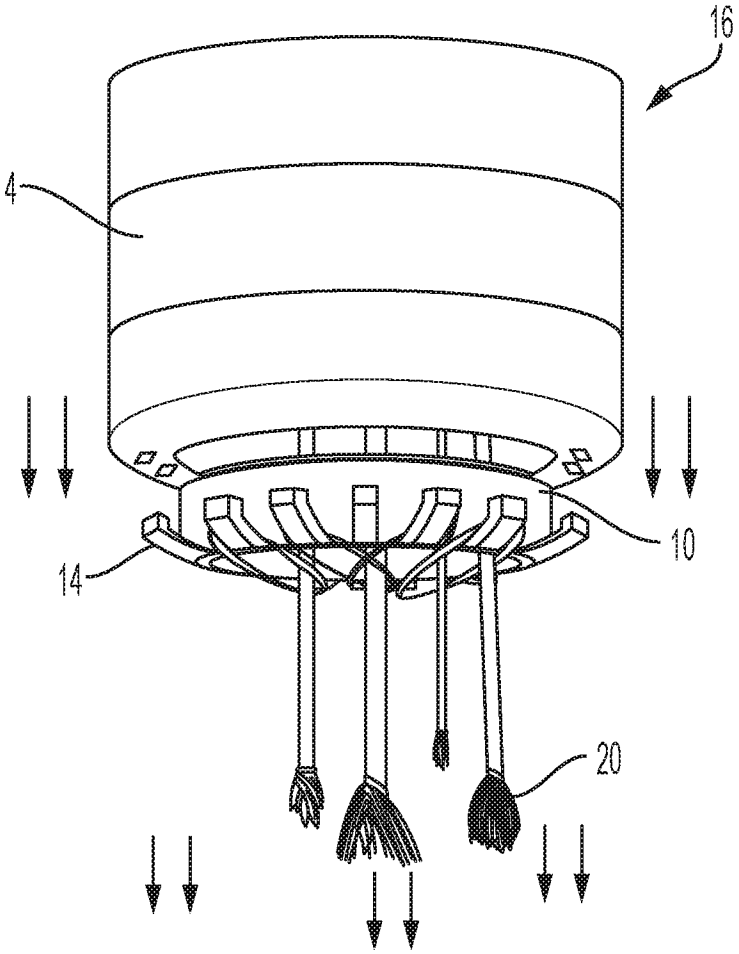
FIGS. 2A and 2B are diagrams that present side views of a portion of a case that is an embodiment of the present invention.
Figure 2A:
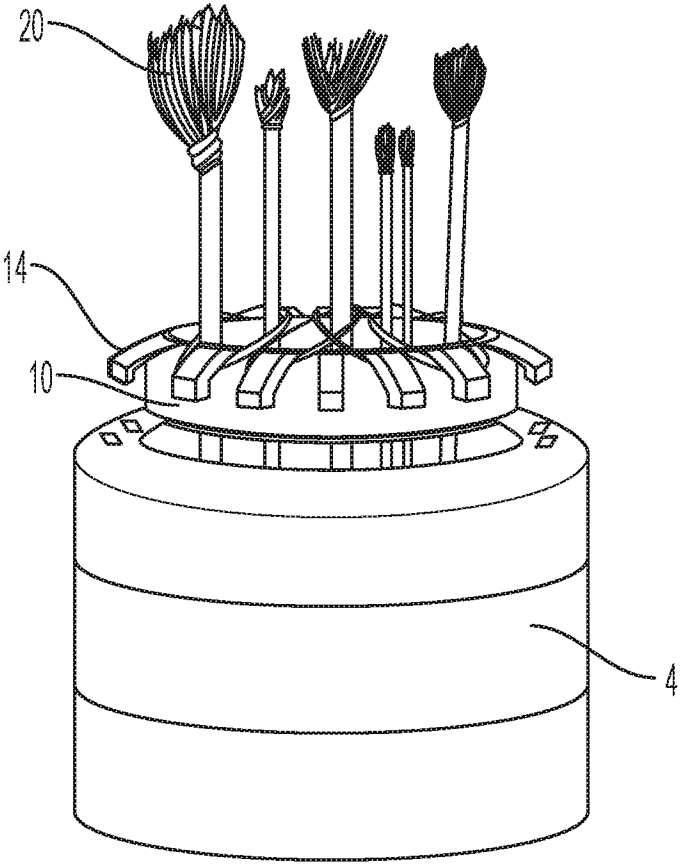

FIG. 2 illustrates a side view of a portion of a case that is an embodiment of the present invention. Specifically shown is a base 4, which comprises a series of hooks 10, both of which were also displayed in the embodiment of the invention represented in FIG. 1. Additionally, FIG. 2 shows one or more rubberized or elasticized bands 14, which are configured to attach to one or more of the series of hooks 10, thereby creating tension in the one or more rubberized or elasticized bands 14. It will be apparent to one of skill in the art that the bands 14 are to be overlapped or used individually to create grid-like sections for which cosmetic tools may be inserted and thereby held and secured. One or more cosmetic tools 20 may be inserted into or between one or more of the bands 14 such that the tension in the one or more bands 14 stabilize the tools 20 and adequately secure them, even when the base 4 is turned in an upside-down position 16.

One of skill in the art will understand that tension in any of the bands 14 may be adjusted such that any inserted cosmetic tool 20 may be adequately secured. Such adjustment may be had by any manner commonly known to a skilled artisan, including, but not limited to, adjusting the length of the band, adjusting the tensile strength of the band, and/or using one or more bands with different elasticities.

Figure 3:
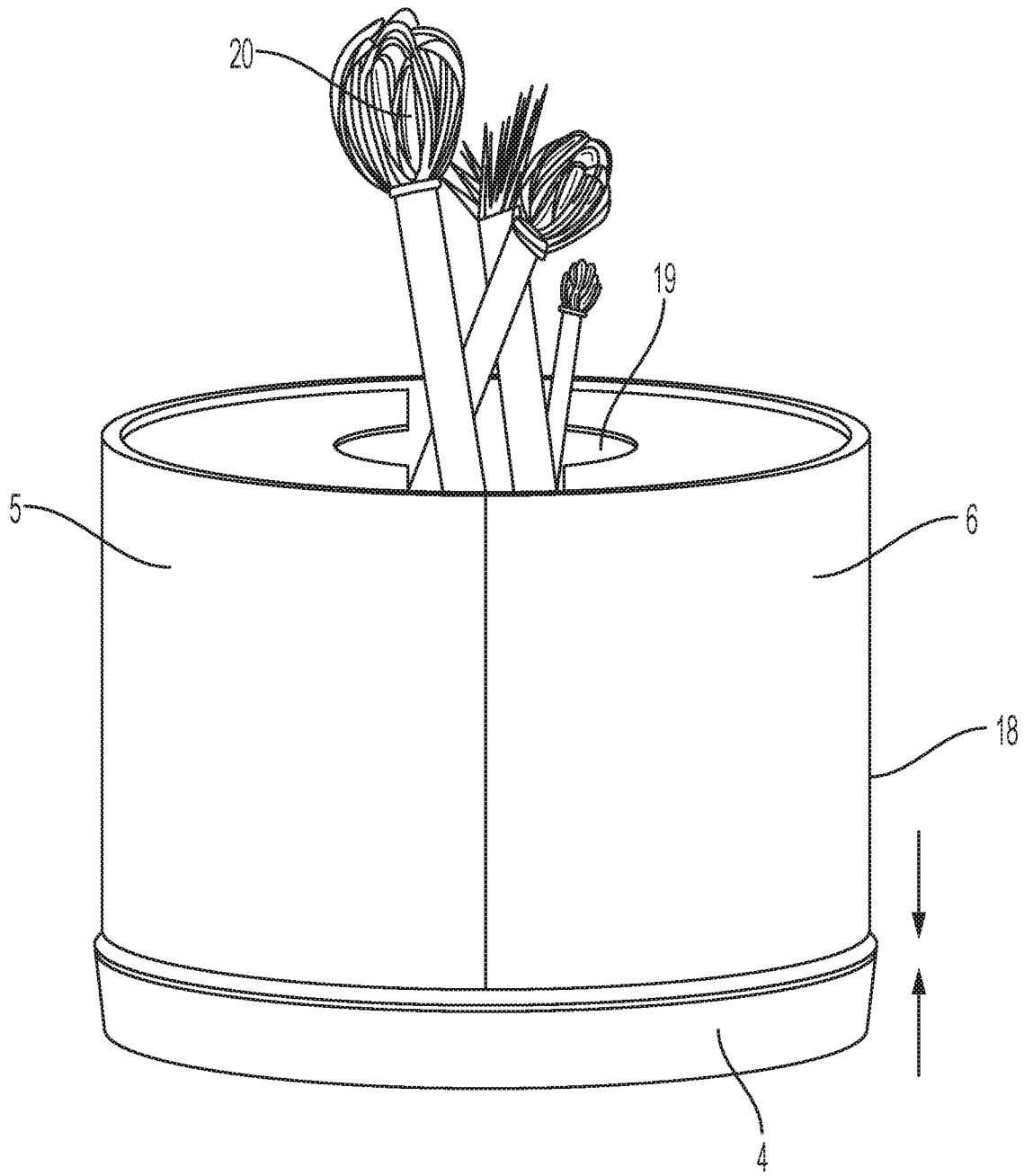
FIG. 3 is a diagram that presents a side/top perspective view of an assembled case that is an embodiment of the present invention.

FIG. 3 illustrates a side perspective view of an assembled case that is an embodiment of the present invention. The assembled case 18 comprises two halves 5 and 6 of a top portion, as well as a base 4. It should be appreciated that the assembled case 18 may be constructed in a manner similar to, or consistent with, the description of the embodiment of the invention represented in FIG. 1.

In the embodiment represented in FIG. 3, there is an open space 19 through which one or more cosmetic tools 20, including, but not limited to, makeup brushes, may extend, thereby avoiding damage to the one or more cosmetic tools, for example from a closed top that might impact the brush heads. One of skill in the art will further appreciate that the one or more cosmetic tools 20 may be held and secured in the interior of the assembled case 18 (not pictured) in manner similar to, or consistent with, the description of the embodiment of the invention represented in FIG. 1.

Figure 4A:
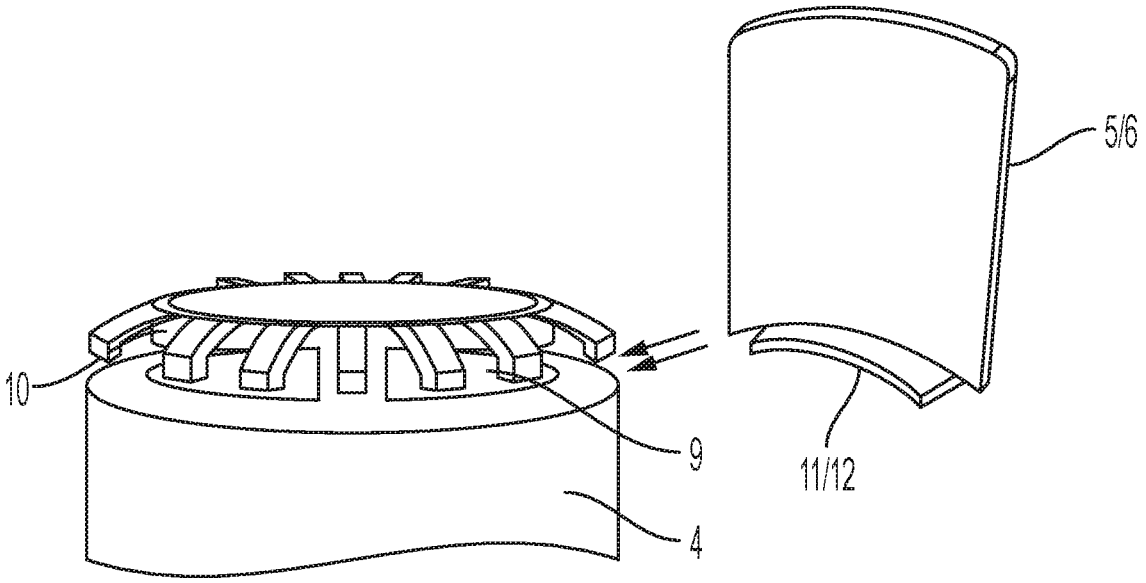
FIGS. 4A and 4B area diagrams that presents side perspective views of various elements of a case that is an embodiment of the present invention.
Figure 4B:
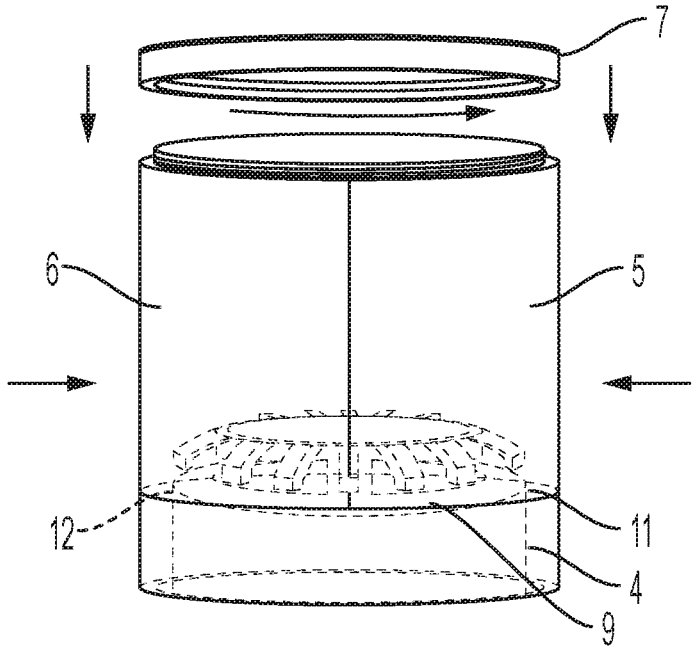

FIG. 4 illustrates a side perspective view of various elements of a case that is an embodiment of the present invention. Among the elements shown is a base 4, which comprises a series of hooks 10, both of which were also displayed in the embodiment of the invention represented in FIGS. 1-2. Additionally shown is a cavity 9 for attaching the two halves 5 and 6 of a top portion to the base 4. In the embodiment represented in FIG. 4, the two halves 5 and 6 are identical to each other and, as a result, only one such half is displayed. Each of the two halves 5 and 6 comprises a protrusion, either 11 or 12, that is configured to connect to the cavity 9. In this manner, the two halves 5 and 6 connect to the base 4.

After such attachment, a lid 7 may be placed so as to contact the two halves 5 and 6. It should be appreciated that the lid 7 may attach to the two halves 5 and 6 in any manner known to one of skill in the art, including, but not limited to, threads.

Figure 5:
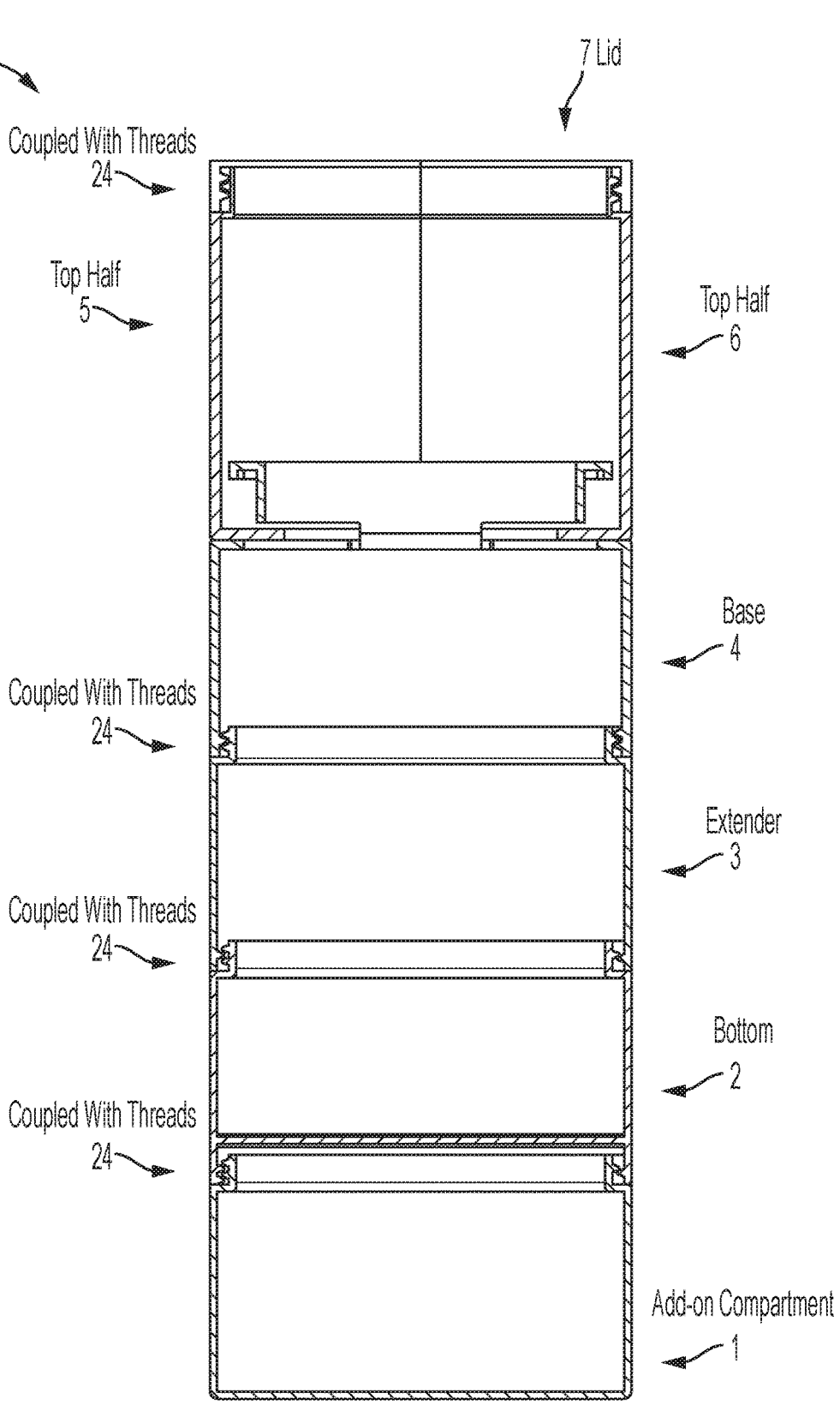
FIG. 5 is a schematic that presents a section view of an assembled case according to one embodiment of the present invention.

FIG. 5 illustrates a section view (taken along the section line shown in FIG. 10) schematic of an assembled case that is an embodiment of the present invention. The assembled case 22 comprises a base 4, two halves 5 and 6 of a top portion, a lid 7, as well as an add-on component 1, a bottom 2, and an extender 3. It should be appreciated that the assembled case 22 is constructed so that there is a plurality of joints 24 that occur where different portions of the case contact each other. As illustrated in FIG. 5, these joints 24 occur between lid 7 and the two halves 5 and 6; between base 4 and extender 3; between extender 3 and bottom 2; and between bottom 2 and add-on component 1. At each of these joints 24, there may be one or more types of attachment means between the different portions of the case. Such attachment means include, but are not limited to, threads, magnets or magnetic closures, snap joints, and the like. One of skill in the art will appreciate that one or more of different types of attachment means may be used in one or more of the joints 24.

Figure 6:
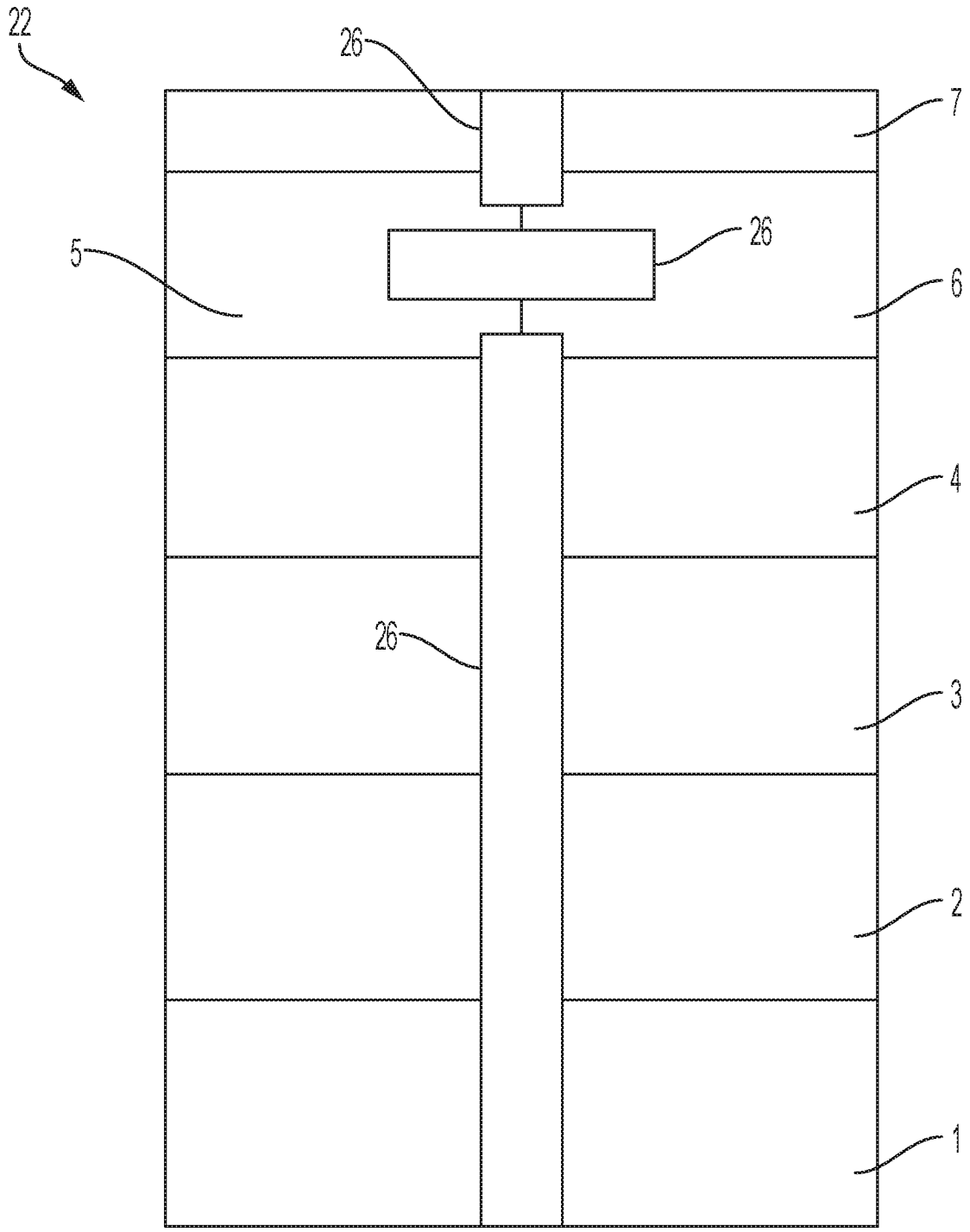
FIGS. 6-8 are schematics that each present a side view of an assembled case according to an embodiment of the present invention.

FIG. 6 illustrates a side view schematic of an assembled case that is an embodiment of the present invention. The assembled case 22 is functionally similar to the case depicted in FIG. 5, at least in that the assembled case 22 depicted in FIG. 5 comprises a base 4, two halves 5 and 6 of a top portion, a lid 7, as well as an add-on component 1, a bottom 2, and an extender 3. The assembled case 22 additionally comprises a plurality of hook and loop fasteners, depicted as shaded areas 26. As illustrated, there are three separate areas of hook and loop fasteners 26, although one of skill in the art will recognize that fewer or greater areas may be utilized. These hook and loop fasteners 26 are disposed on the case to attach one or more portions of the assembled case 22 to one or more other portions of the assembled case. For example, a hook fabric may run along the sides of each portion 1, 2, 3, 4, 5, 6, 7 and then a strip of loop fabric may be applied across the hook fabric on portions 1, 2, 3, 4, another strip of loop fabric may be applied across the horizontal hook fabric on portions 5 and 6, and another strip of loop fabric may be applied across the hook fabric on portion 7 and the top of portions 5/6, the hook fabric portions being lined up so that a single strip of loop fabric can be applied across multiple portions. Methods of hook and loop fabric attachment of various objects are generally well known, and these connections are therefore not illustrated in detail.

Figure 7:
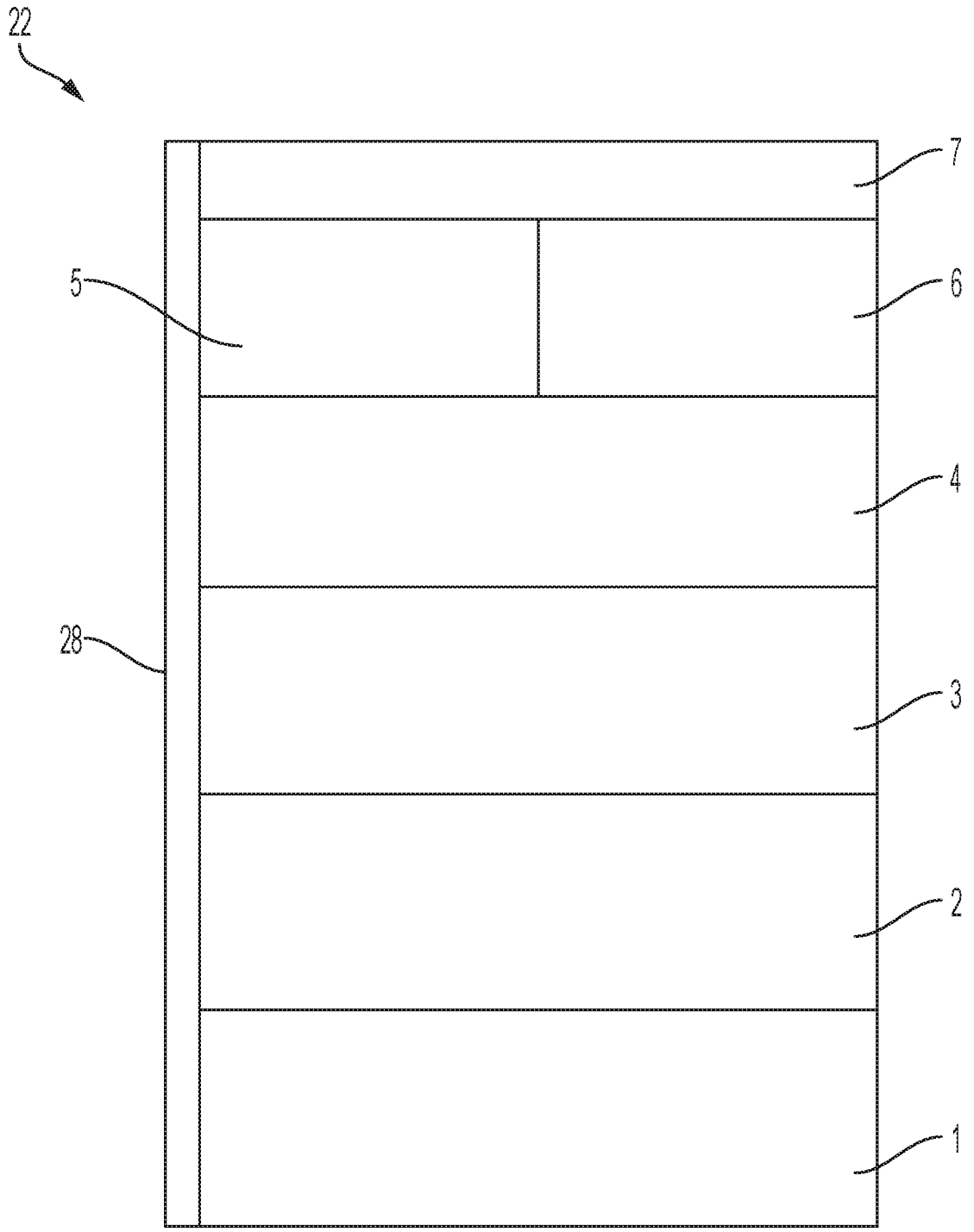

FIG. 7 illustrates a section view (taken along the section line shown in FIG. 10) schematic of an assembled case that is an embodiment of the present invention. The assembled case 22 is functionally similar to the case depicted in FIG. 5, at least in that the assembled case 22 depicted in FIG. 6 comprises a base 4, two halves 5 and 6 of a top portion, a lid 7, as well as an add-on component 1, a bottom 2, and an extender 3. The assembled case 22 additionally comprises a spine structure, depicted as shaded area 28. As illustrated, the spine structure 28 physically contacts each portion of the assembled case 22 such that the spine structure attaches all of the portions of the assembled case together. The spine 28 may for example be a rigid metal or plastic material, or flexible fabric material, which attaches to each portion 1,2,3,4,5,7 of the case to secure these portions together. Any known attachment mechanism may be used between the spine 28 and the portions 1, 2, 3, 4, 5, 7, such as snap or click-fit connections, magnets, hook and loop, etc.

Figure 8:
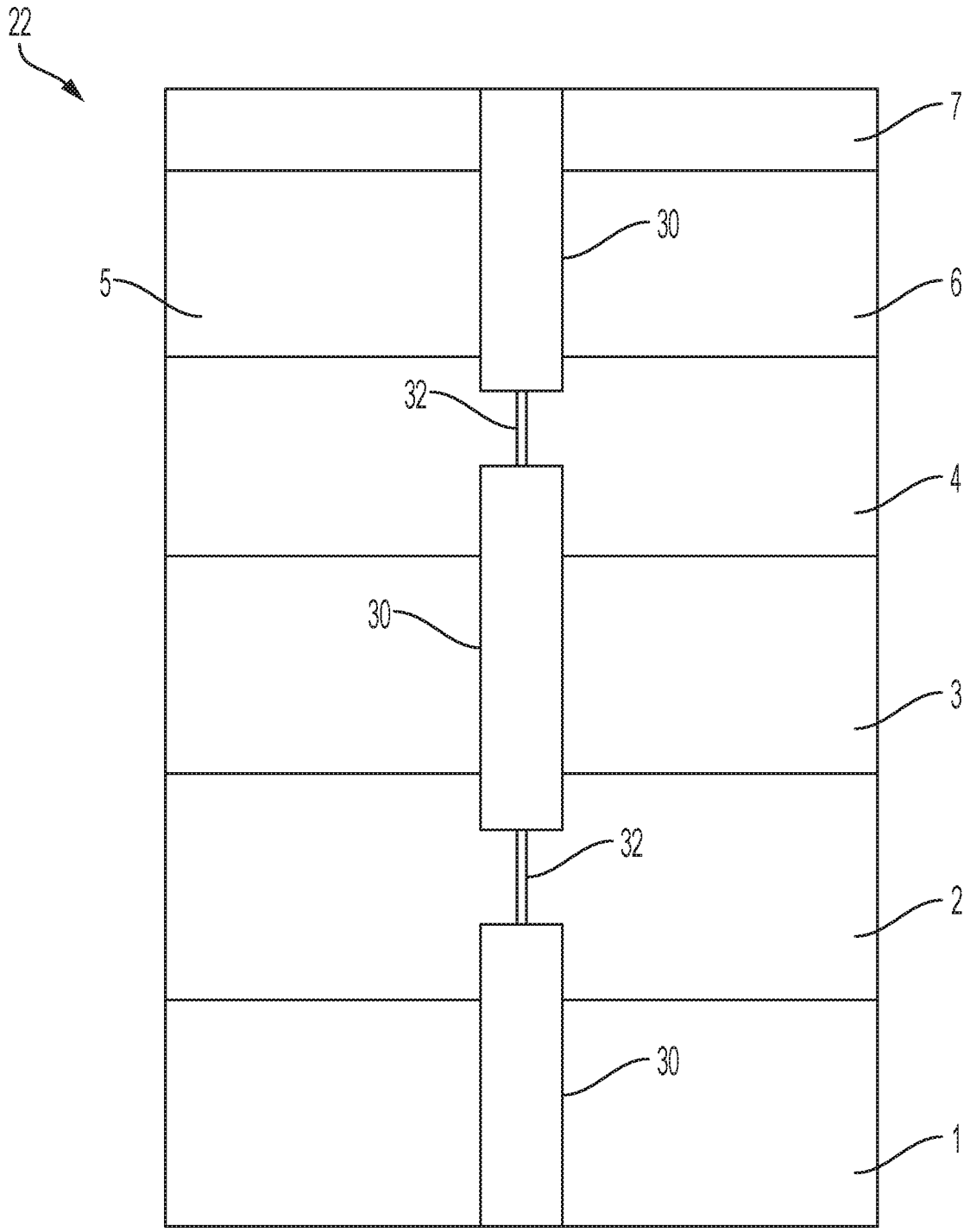

FIG. 8 illustrates a section view (taken along the section line shown in FIG. 10) schematic of an assembled case that is an embodiment of the present invention. The assembled case 22 is functionally similar to the case depicted in FIG. 5, at least in that the assembled case 22 depicted in FIG. 7 comprises a base 4, two halves 5 and 6 of a top portion, a lid 7, as well as an add-on component 1, a bottom 2, and an extender 3. The assembled case 22 additionally comprises a plurality of buckle closures and/or buckle clips, depicted as shaded areas 30 and 32. As illustrated, there are two separate clasp mechanisms 32, which connect three separate areas of straps 30 together. The mechanisms 32 and the straps 30 are disposed on the assembled case 22 so as to attach one or more portions of the assembled case to one or more other portions of the assembled case. One of skill in the art will recognize that fewer or greater clasp mechanisms and/or straps may be used so as to attach one or more portions of the assembled case 22 to one or more other portions of the assembled case. Clasp mechanisms for attaching various parts are well known, and therefore are not illustrated in detail.

Figure 9:
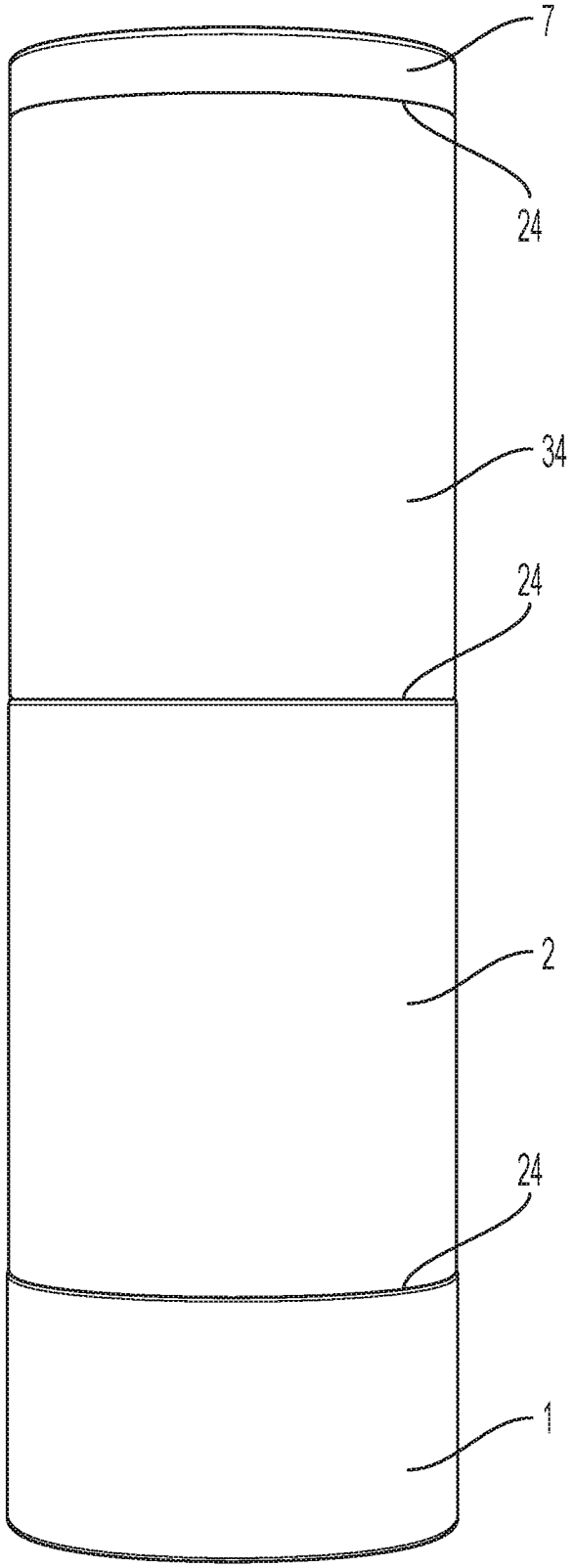
FIG. 9 is a side view of an assembled cosmetics case according to an embodiment of the present invention.

FIG. 9 is a perspective view of an assembled cosmetics case according to an embodiment of the present invention. In this embodiment, there is no base 4 and top portion 5,6 as described in FIGS. 1-8. Portion 34 has an open top and bottom and middle. In some other embodiments, portion 34 may have an internal barrier separating its internal cavity in two, while retaining an open top and bottom. As shown, bottom 2 is attached below portion 34 and is open at the top and closed at the bottom. The lid 7, portion 34 and bottom 2 combine when attached to form an enclosed cavity in which cosmetic or other items can be stored. Add-on compartment 1 has an open top and closed bottom, and when attached to the bottom of the bottom portion 2 forms a second cavity that can be used to store make-up sponges or other items. The connections 24 between the top 7, portion 34, bottom 2, and add-on compartment 1 may be any known connection mechanism, as discussed previously.

In an alternative version of the embodiment of FIG. 9, single piece 34 with an open top and bottom or bottom 2 may have the projections/hooks of base 4 and therefore be, in a sense, a combination of base 4 and top portions 5,6 in a single piece. A disadvantage of using a single piece rather than having separable/removable top portions 5,6 is that a user may have more difficulty attaching bands to the hooks of the base given the limited room for inserting fingers. However, such disadvantages can be alleviated for example by pre-attaching the bands and/or using permanently affixed bands/cords etc., although permanently affixed bands reduces the customizability of the case.

Figure 10:
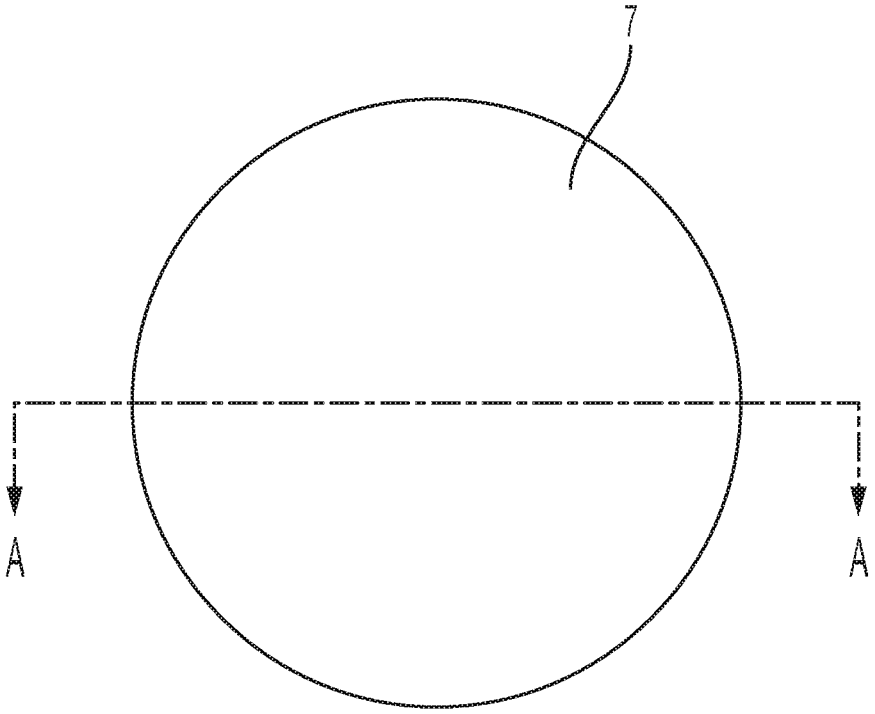
FIG. 10 is an overhead view of an assembled cosmetics case according to an embodiment of the present invention.

FIG. 10 is an overhead view of an assembled cosmetics case according to an embodiment of the present invention, in which only the lid 7 is visible.

Figure 11:
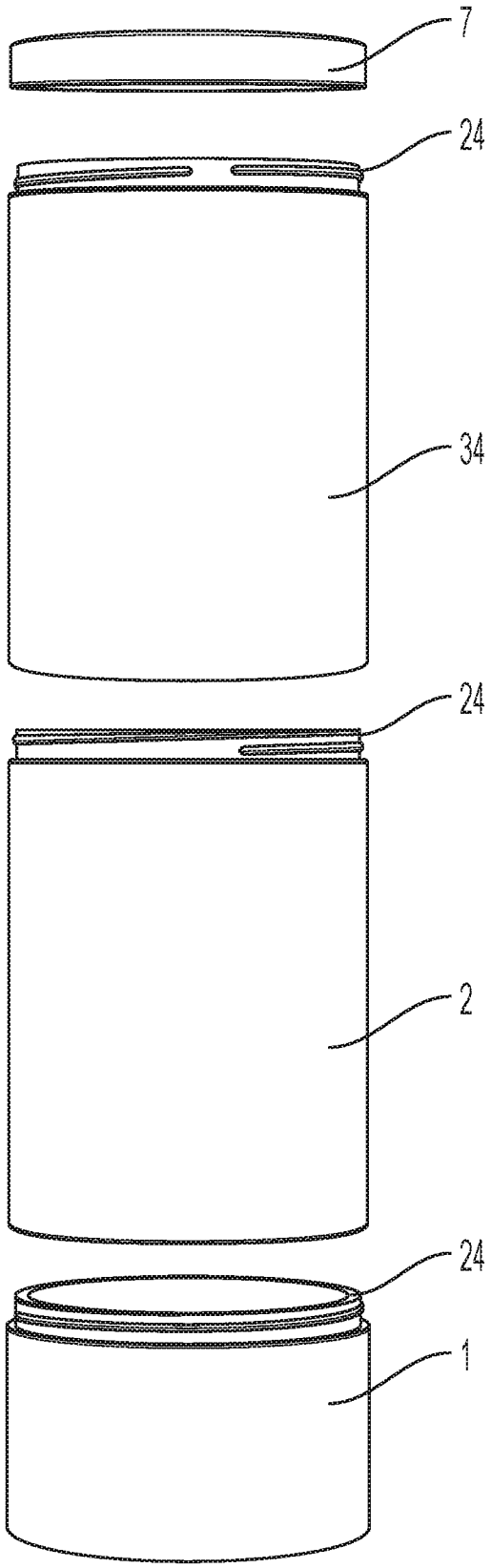
FIG. 11 is an exploded side view of the cosmetics case shown in FIG. 9.

FIG. 11 is an exploded side view of the cosmetics case shown in FIG. 9. Male threads 24 are visible, while the corresponding female threads are on interior surfaces and therefore not visible. In other embodiments connections 24 may be any known attachment mechanisms, including hook and loop, buckle fasteners, click-fit, etc.

Figure 12:
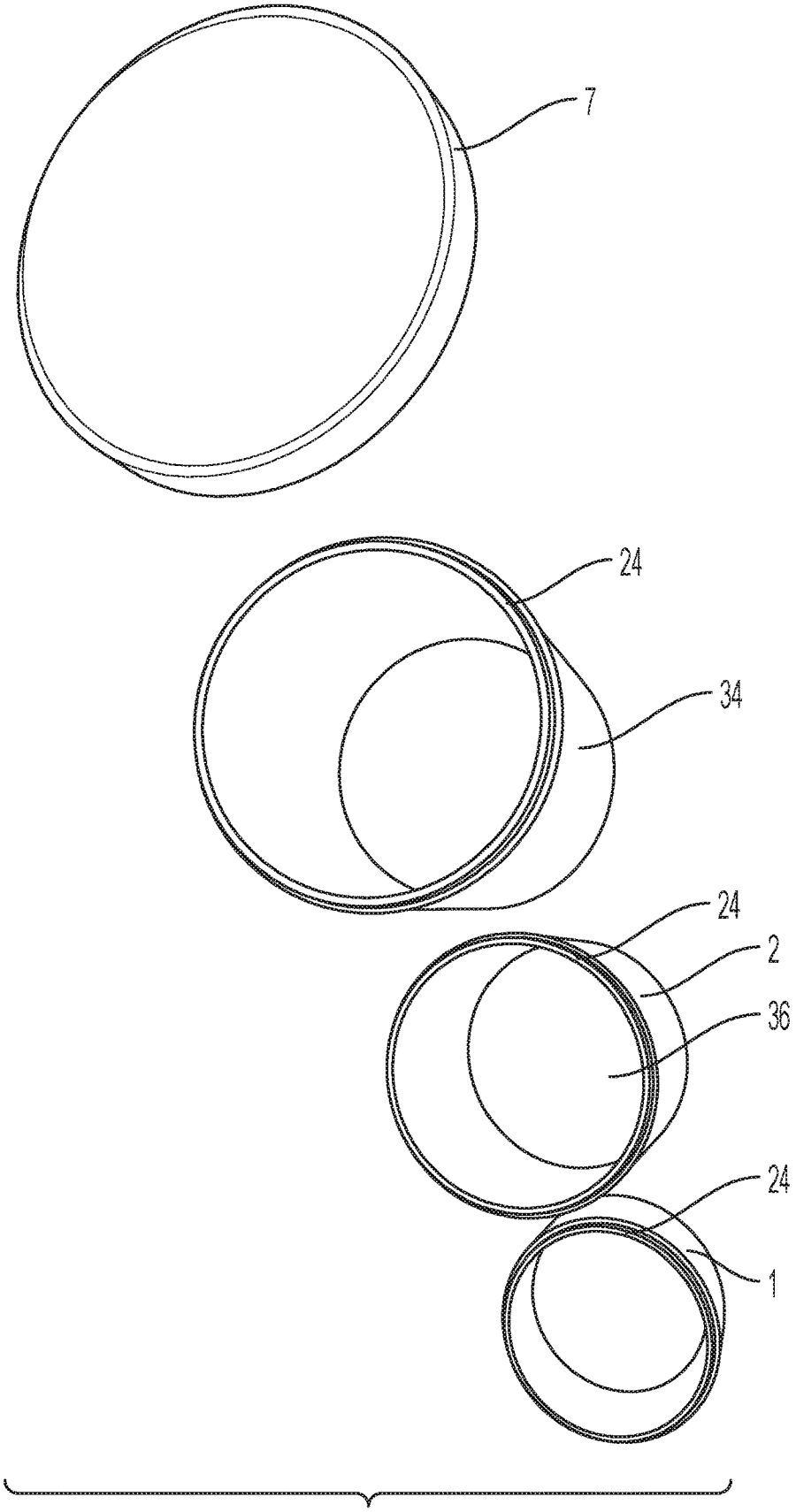
FIG. 12 is an exploded top perspective view of the cosmetics case shown in FIG. 9.

FIG. 12 is an exploded top perspective view of the cosmetics case shown in FIG. 9. Here, it is visible that portion 34 has an open top and bottom, while bottom 2 has a closed bottom 36, as does add-on compartment 1.

Figure 13:
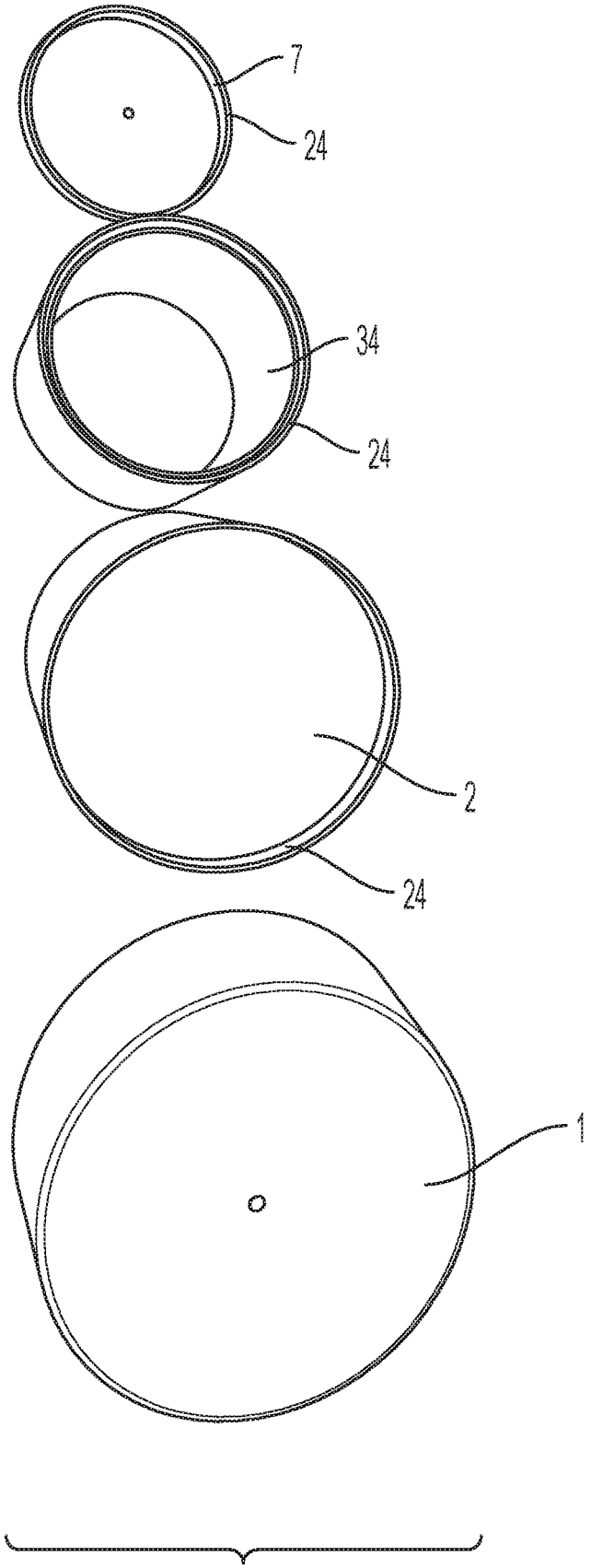
FIG. 13 is an exploded bottom perspective view of the cosmetics case shown in FIG. 9.

FIG. 13 is an exploded bottom perspective view of the cosmetics case shown in FIG. 9. Here, the female interior threads 24 are visible.

In the embodiments of FIGS. 9-13, each male/external threading can be connected with each female/internal threading interchangeably. Hence, lid 7 can be applied to portion 34, but it can also be applied to bottom 2, or add-on compartment 1. Portion 34 can be attached directly to add-on compartment 1. Bottom 2 can be attached to the top of portion 34. Therefore, many different assembled cases can be created from these four components. For example, the portions may be reconfigured to form a complete assembly with add-on compartment 1 on the bottom, portion 34 above that, bottom portion 2 above portion 34, and lid 7 on top. To maximize the number of combinations, lids may also be used that have external rather than internal threads, and similarly different embodiments of each portion 1, 2, 34 may have internal or external threads at each connection point 24. Of course, each portion in various embodiments may have different heights and even widths/shapes, as long as the connection points still mate, for different applications and maximal variation.

It should be understood that the embodiments shown in FIGS. 9-13 can be used with the base portion 4 and halves 5, 6 of FIGS. 1-8, either by substituting the portion 4 and halves 5,6 for one of the portions 1, 2, 34, or by adding the portion 4 and halves 5,6 combination to the portions 1, 2, 34, 7 shown, thereby enlarging the case.

These and other objectives and features of the invention are apparent in the disclosure, which includes the above and ongoing written specification. The invention is not limited to the particular embodiments illustrated in the drawings and described above in detail. Those skilled in the art will recognize that other arrangements could be devised. The invention encompasses every possible combination of the various features of each embodiment disclosed. One or more of the elements described herein with respect to various embodiments can be implemented in a more separated or integrated manner than explicitly described, or even removed or rendered as inoperable in certain cases, as is useful in accordance with a particular application. While the invention has been described with reference to specific illustrative embodiments, modifications and variations of the invention may be constructed without departing from the spirit and scope of the invention as set forth in the following claims.

I claim:

1. A case for storing one or more cosmetic tools, the case comprising:

a first portion comprising a bottom surface, a top opening, and one or more first side walls extending upwards from a perimeter of the bottom surface and forming, together with the bottom surface, a first internal cavity for storing one or more of the one or more cosmetics tools therein;

a second portion comprising a top surface, a bottom opening, and one or more second side walls extending downwards from a perimeter of the top surface and forming, together with the top surface, a second internal cavity;

a base portion that comprises two or more projections and a bottom surface;

one or more upper portions, wherein at least one of the one or more upper portions is configured to attach to the base portion to form a base internal cavity for storing at least one of the one or more cosmetic tools; and one or more further portions each comprising one or more further side walls and at least one further opening at an end of at least one of the one or more further side walls, one or more of the one or more further side walls encircling a further internal cavity;

wherein the projections are configured such that elastic bands may be attached between the two or more projections to divide space in the base internal cavity;

wherein the one or more first sidewalls comprise a first connector at the top opening, the one or more second side walls comprise a second connector at the bottom opening, and the one or more further sidewalls comprise a further connector at each of the at least one further openings;

wherein the bottom surface comprises a base connector configured to connect to and mate with the first connector or the second connector;

wherein the first connector is configured to mate and connect with the second connector;

wherein each further connector is configured to mate and connect with the first connector or the second connector;

wherein the first portion, the second portion, and/or one or more of the further portions further comprises a supplemental connector on an end of the one or more first side walls, the one or more second side walls or further sidewall opposite to the first connector, second connector or further connector, the supplemental connector configured to mate with and connect to at least one of the first connector and the second connector;

wherein mating and connecting the first portion and the second portion causes the first portion and the second portion to merge the first internal cavity and the second internal cavity to form a first combined internal cavity for receiving the one or more cosmetics tools therein;

wherein each further portion is configured, when connected by the further connector to the first portion or the second portion, to merge the further internal cavity with the first internal cavity or the second internal cavity to form a second combined internal cavity, to expand the first combined internal cavity.

2. The case of claim 1, wherein at least one of the two or more projections are placed in a first plane.

3. The case of claim 2, wherein the two or more projections extend outwards.

4. The case of claim 3, wherein the two or more projections are distributed around an outer perimeter of the first portion.

5. The case of claim 4, wherein at least one of the two or more projections are hooks.

6. The case of claim 5, wherein the outer perimeter of the base portion is circular.

7. The case of claim 6, wherein the one or more upper portions form a side wall that surrounds the projections.

8. The case of claim 1, further comprising one or more bands configured to attach to the one or more projections.

9. The case of claim 8, wherein the bands are attached to the one or more projections and form a grid dividing the space in the base internal cavity, into which items may be placed.

10. The case of claim 1, wherein the base portion comprises a cavity on an exterior surface of the base portion, the cavity defining an attachment space.

11. The case of claim 10, wherein at least one of the one or more upper portions further comprises an attachment portion configured to attach to the base.

12. The case of claim 11, wherein the attachment portion comprises a first half and a second half, wherein the first half comprises a first protrusion and the second half comprises a second protrusion, and wherein the first protrusion and the second protrusion fit into the attachment space defined by the cavity.

* * * * *